United States Patent [19]

Hauerwas et al.

[11] Patent Number: 5,033,485

[45] Date of Patent: Jul. 23, 1991

[54] ELECTRIC FINGERNAIL FILE APPARATUS

[76] Inventors: Glen T. Hauerwas; Troy T. Hauerwas, both of HC12-Box 312, Coeur D'Alene, Id. 83814

[21] Appl. No.: 493,628

[22] Filed: Mar. 15, 1990

[51] Int. Cl.[5] ..... A45D 29/05

[52] U.S. Cl. ..... 132/73.6; 132/75.6; 132/75.8

[58] Field of Search ..... 132/73, 73.5, 73.6, 132/75.6, 75.8, 76.4

[56] References Cited

U.S. PATENT DOCUMENTS

| | | | |
|---|---|---|---|
| 1,742,862 | 1/1930 | Jones | 132/75.8 |
| 1,831,327 | 11/1931 | Surdock | 132/73.6 |
| 2,923,303 | 2/1960 | Hundt | 132/75.8 |
| 3,240,966 | 3/1966 | Thompson | 132/73.6 |
| 4,408,623 | 10/1983 | Murray | 132/75.8 |
| 4,643,207 | 2/1987 | Grahame | 132/75.8 |

FOREIGN PATENT DOCUMENTS

| | | | |
|---|---|---|---|
| 3022616 | 1/1982 | Fed. Rep. of Germany | 132/73.6 |

*Primary Examiner*—Gene Mancene
*Assistant Examiner*—Michael Lynch
*Attorney, Agent, or Firm*—Leon Gilden

[57] ABSTRACT

An electric fingernail file apparatus is set forth wherein various components of the organization, including batteries, motor, output motor shaft, and reciprocating file, are in an axially aligned relationship relative to the housing, wherein alternatively a remote flexible drive cable may be directed through the housing in an axially aligned relationship relative to the housing and the aforenoted file.

2 Claims, 4 Drawing Sheets

ELECTRIC FINGERNAIL FILE APPARATUS

BACKGROUND OF THE INVENTION

1. Field of the Invention

The field of invention relates to electrical manicuring devices, and more particularly pertains to a new and improved electric fingernail file apparatus wherein the same provides aligned reciprocation of a fingernail file relative to an elongate axis of a housing minimizing vibration thereof.

2. Description of the Prior Art

The prior art has utilized manicuring devices mechanically enhanced to effect fingernail filing and the like, but heretofore has not provided organizations to minimize vibration in use of the apparatus. For example, U.S. Pat. No. 4,408,623 to Murray utilizes an angularly tilted drive wheel mounted to an output shaft of a motor for reciprocation of a file which inherently imparts vibration of the organization due to the offset relationship of the file and the motor output axis shaft.

U.S. Pat. No. 4,643,207 to Grahame provides an electrical manicuring device wherein the same utilizes a pivoting forward file member actuated by a rotary cam positioned on the end of an electrical motor output shaft wherein the inherent pivoting of the file member imparts undesirable vibration to the organization during use.

U.S. Pat. No. 4,103,694 to Burian, et al., sets forth a manicuring device utilizing a rotary manicuring member effecting rotary motion coaxially of the output of the motor but fails to provide the reciprocatory motion of the instant invention to effect a filing motion commonly associated in a manicuring procedure.

U.S. Pat. No. 4,137,926 sets forth a battery operative manicuring device wherein rotary type files are mounted coaxially of a motor unit orthogonally related to an associated housing, as opposed to the reciprocatory drive of the instant invention.

U.S. Pat. No. 3,916,921 to Pesola sets forth an electrically operative nail file powered by a shifting magnetic field to reciprocate the associated file of the housing and while of an axially aligned nature relative to the housing, fails to provide the mechanical linkage of the instant invention directing and imparting the full torque of the associated electric motor associated with the instant invention through intercommunicating bevel gears.

As such, it may be appreciated that there is a continuing need for a new and improved electric fingernail file apparatus wherein the same addresses both the problems of ease of use and effectiveness in organization and in this respect, the present invention substantially fulfills this need.

SUMMARY OF THE INVENTION

In view of the foregoing disadvantages inherent in the known types of electric fingernail file apparatus now present in the prior art, the present invention provides an electric fingernail file apparatus wherein the same provides reciprocatory motion in a coaxially aligned arrangement relative to a motor and drive mechanism of the motor, as well as with the associated battery elements. As such, the general purpose of the present invention, which will be described subsequently in greater detail, is to provide a new and improved electric fingernail file apparatus which has all the advantages of the prior art electric fingernail organizations and none of the disadvantages.

To attain this, the electric fingernail file apparatus of the instant invention essentially comprises an elongate hollow housing including a single or plurality of batteries coaxially aligned of the housing arranged rearwardly of an electric motor. The electric motor includes an output shaft coaxially aligned with the housing with a first gear coaxially mounted to the output shaft with a second gear arranged to cooperate with the first gear. A fingernail file is coaxially aligned relative to the output shaft of the motor eccentrically mounted to the second gear for reciprocatory motion of the fingernail file with a removable forward housing portion including an elongate groove to guide the fingernail file therethrough removable from the main housing to enable replacement of repair of the fingernail file in use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved electric fingernail file apparatus which has all the advantages of the prior art electric fingernail file organizations and none of the disadvantages.

It is another object of the present invention to provide a new and improved electric fingernail file apparatus which may be easily and efficiently manufactured and marketed.

It is a further object of the present invention to provide a new and improved electric fingernail file apparatus which is of a durable and reliable construction.

An even further object of the present invention is to provide a new and improved electric fingernail file apparatus which is susceptible of a low cost of manufacture with regard to both materials and labor, and which accordingly is then susceptible of low prices of sale to the consuming public, thereby making such electric fingernail file apparatus economically available to the buying public.

Still yet another object of the present invention is to provide a new and improved electric fingernail file apparatus which provides in the apparatuses and methods of the prior art some of the advantages thereof, while simultaneously overcoming some of the disadvantages normally associated therewith.

Still another object of the present invention is to provide a new and improved electric fingernail file apparatus wherein the same enables reciprocatory motion coaxially aligned relative to an associated housing and drive mechanism of the apparatus for minimizing vibration and effectiveness in use of the organization.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a further modified drive mechanism of the instant invention.

DESCRIPTION OF THE PREFERRED EMBODIMENT

Figure 1:
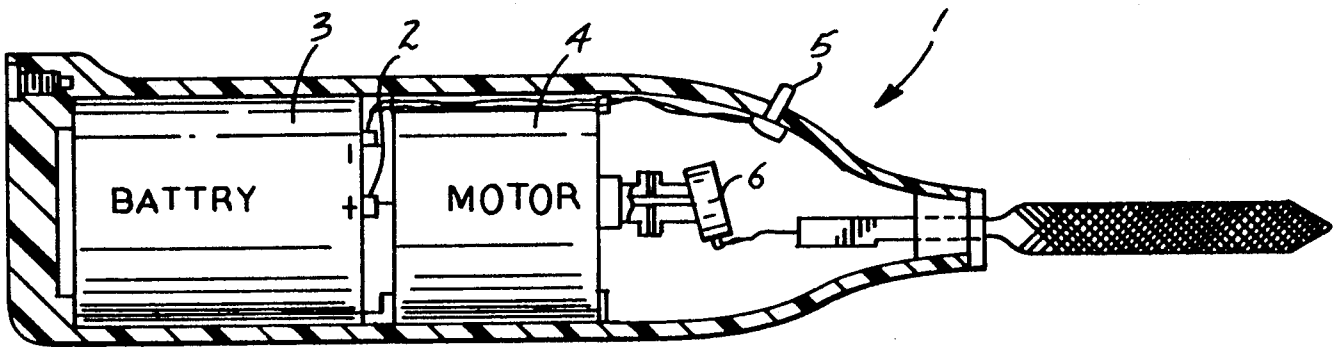
FIG 1 PRIOR ART
FIG. 1 is an orthographic view taken in elevation of the prior art.

With reference now to the drawings, and in particular to FIGS. 1 to 8 thereof, a new and improved electric fingernail file apparatus embodying the principles and concepts of the present invention and generally designated by the reference numeral 10 will be described.

More specifically, the electric fingernail file apparatus 10 essentially comprises an improvement over the prior art devices as exemplified by FIG. 1 and as set forth in U.S. Pat. No. 4,408,623, wherein an elongate housing 2 includes a battery 3, with a forwardly mounted motor 4. A switch 5 electrically communicates the battery 3 to the motor 4. The motor includes an output shaft with an eccentrically mounted fingernail file pivotally secured to a circumference of a drive wheel 6 that is positioned at an inclination relative to the axis of the output shaft motor 4 to reciprocate the associated fingernail file.

Figure 5:
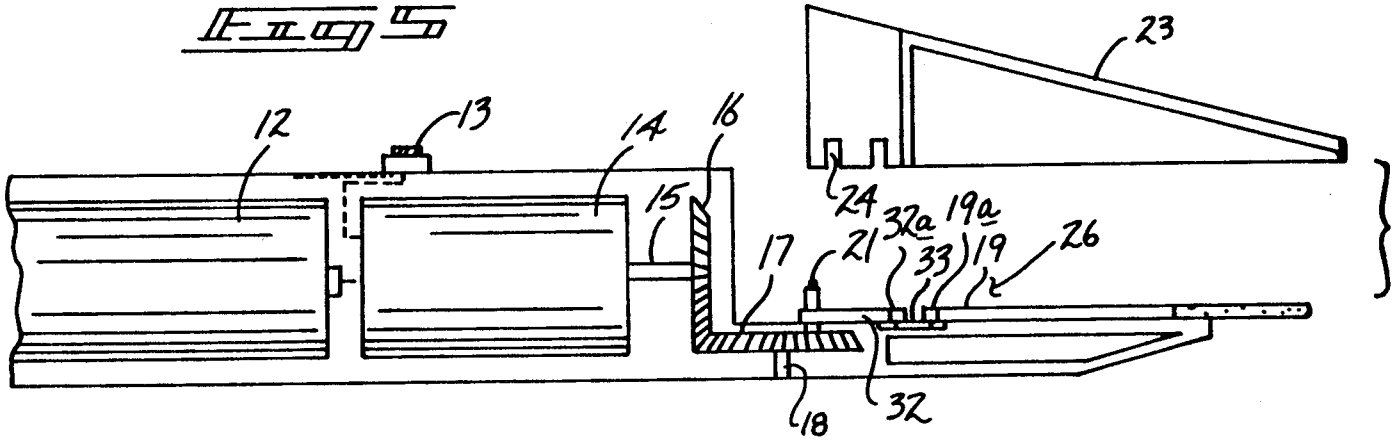
FIG. 5 is an orthographic view illustrating the various components interiorly of the housing of the instant invention illustrating the removal guard nose separated therefrom.

In contradistinction, the instant invention includes at least one, or a plurality of batteries, including a first battery 11 and a second battery 12 coaxially aligned with a forwardly positioned motor 14 operative through a switch 13 to selectively actuate the motor through the batteries 11 and 12. The motor includes a motor output shaft 15 with a first bevel gear 16 coaxially and orthogonally mounted to the output shaft 15. A second bevel gear 17 is operably mounted relative to the first bevel gear 16 and rotates about a second bevel gear axis 18 mounted through a floor of the housing, to be discussed in more detail below. A fingernail file shaft 19 includes an abrasive surface 20 positioned exteriorly of the housing and axially aligned relative thereto. The shaft 19 includes a shaft pivot pin **19*a* orthogonally mounted through the shaft 19 adjacent its rear terminal end to an underlying connector plate 33 formed with a friction reducing coating thereon. A second bevel gear arm 32 includes a file shaft axis 21 mounted to the second bevel gear 17 that is parallel to the second bevel gear axis 18, but offset relative thereto to effect reciprocation of the file upon rotation of the second bevel gear 17. A gear arm pivot pin 19*a* is orthogonally directed through the second bevel gear arm 32 adjacent its forward end and mounted to the underlying connector plate 33 spaced from and parallel to the shaft pivot pin 19*a*. The removable guard nose 23 is received within an "L" shaped recess 26, as illustrated in FIG. 5 for example, of the elongate coaxially aligned housing 22**.

Figure 4:
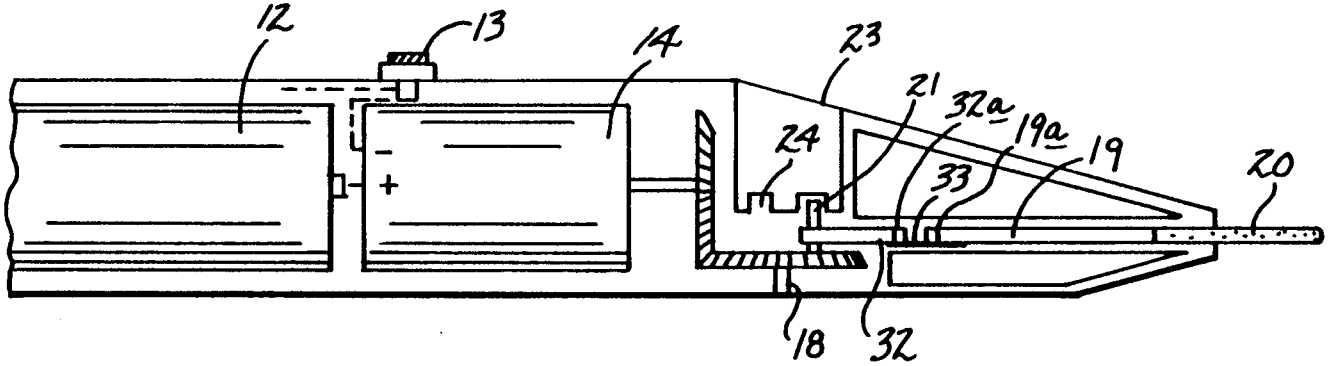
FIG. 4 is a side orthographic view taken in elevation, partially in section, of the various components of the organization, their relationship and their orientation within the organization.
Figures 8, 11:
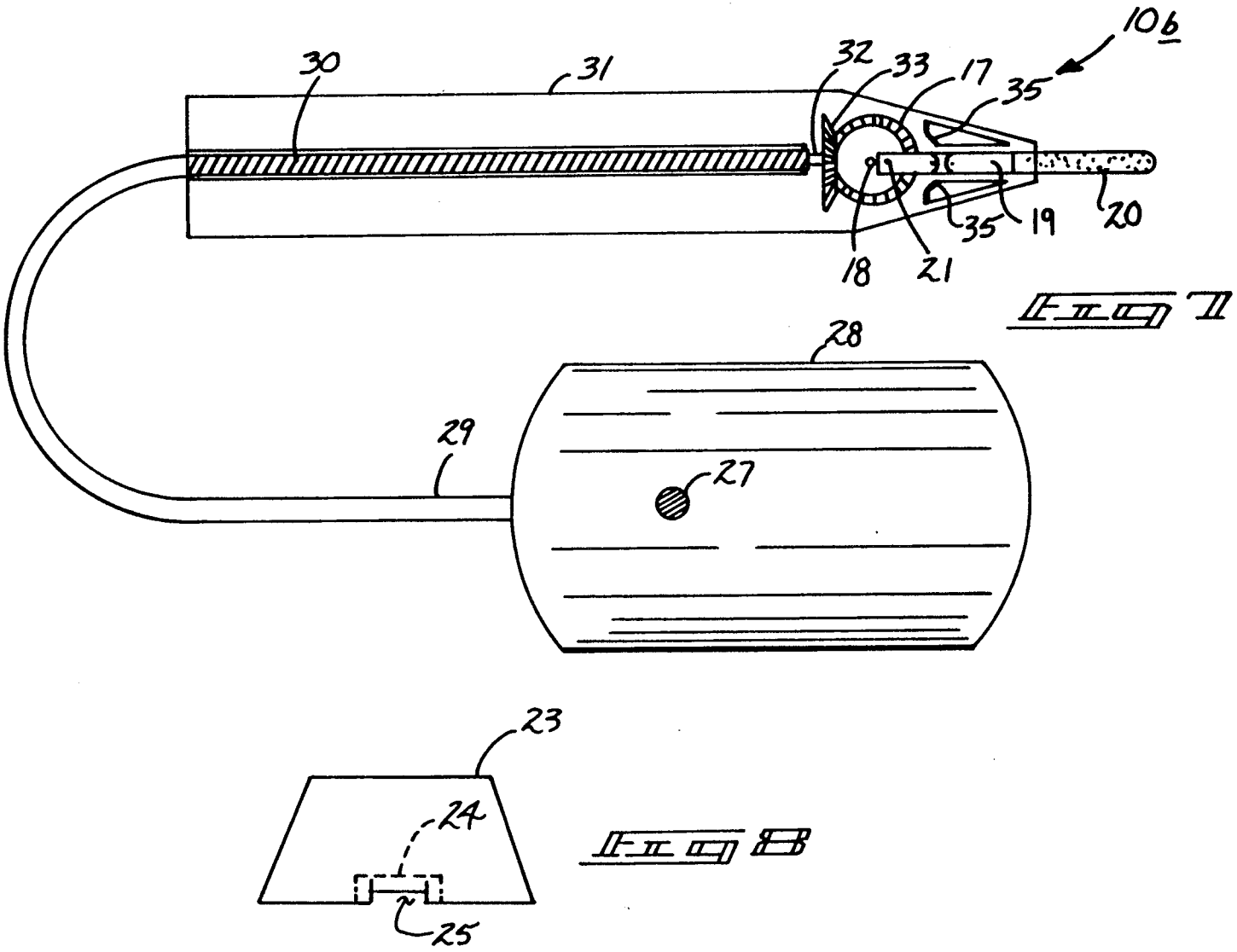
FIG. 8 is a rear orthographic view taken in elevation of the removable guard nose of the instant invention.

The removable guard nose 23 includes a circular guide groove 24 mounted coaxially above the second bevel gear axis 18 and defined by a diameter equal to the diameter defined by the rotation of the file shaft axis 21, as illustrated in FIG. 4 for example. Reference to FIG. 8 notes the use of an elongate nose groove 25 coextensively formed and longitudinally aligned relative to a bottom surface of the removable guard nose 23 to guide the reciprocation of the file 19 therethrough. The groove 25 is defined between spaced and parallel first guide walls that include second guide walls at their rear therminal ends defining an acute included angle therebetween to provide clearance for the pivoting and rotating second bevel gear arm 32. The nose guard 23 is removable to enable access interiorly of the housing for removal or periodic maintenance, such as cleaning, of the file 19 and permitting the replacement of the file shaft 19 with various files of various degrees of abrasiveness, length, and the like.

Figure 2:
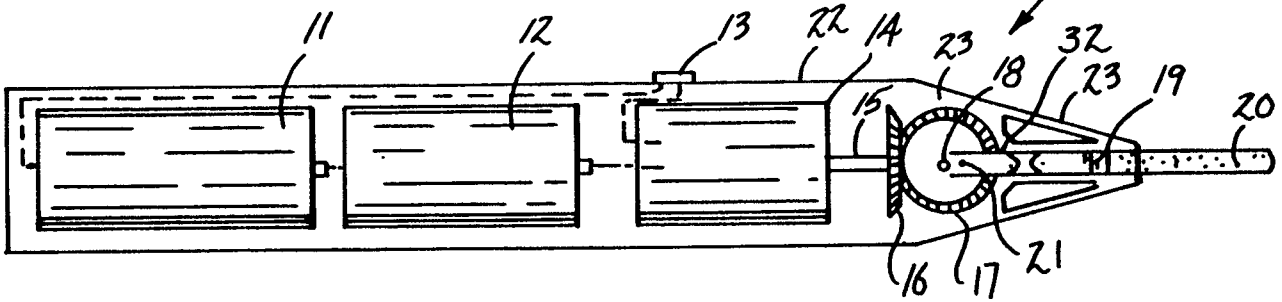
FIG. 2 is an orthographic cross-sectional view of the instant invention.
Figure 3:
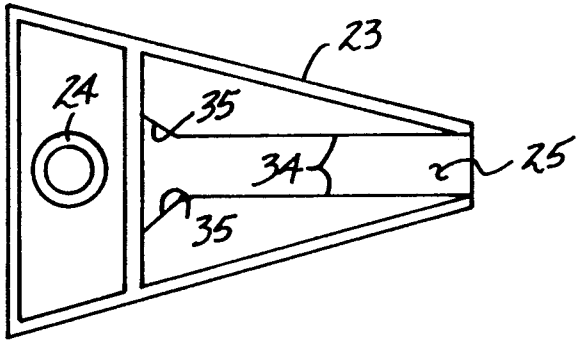
FIG. 3 is a bottom orthographic view of the housing cover of the instant invention.
Figure 6:
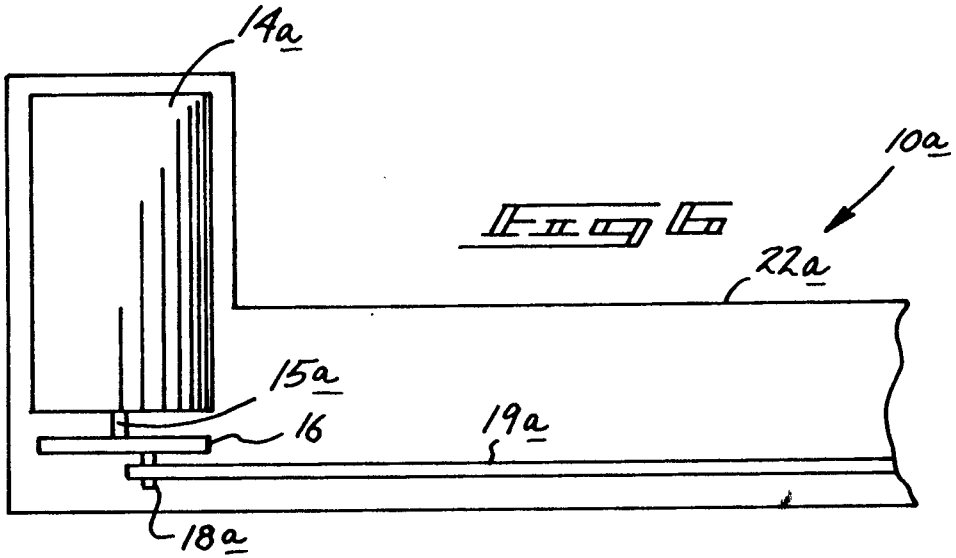
FIG. 6 is a schematic illustration of a modified drive mechanism of the instant invention.

Reference to FIG. 6 illustrates a modified electric fingernail file apparatus drive mechanism wherein the motor 14 includes an output shaft **15*a* orthogonally mounted relative to the elongate housing 22*a* with an eccentric axis 18*a* mounted offset relative to the motor output shaft 15, wherein an elongate link 19*a* mounts an associated nail file extending exteriorly of the housing in a manner comparable to that as illustrated in FIG. 2**.

FIG. 7 illustrates a further modified electric fingernail file apparatus **10*b* including a remote housing 28 including the battery motor that operably associates the motor with a flexible drive cable 30 that extends rotatably within a sheathed cable housing 29 flexibly directed from the elongate housing 31 that is coaxially aligned with the housing 31 with an output shaft 32 mounting the first output shaft bevel gear 33 that in turn is operably associated with the second bevel gear 17 in a manner as set forth in FIG. 2** for example.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An electric fingernail file apparatus comprising, in combination, an elongate hollow coaxially aligned housing, and a motor output drive shaft coaxially aligned within the housing and mounting a first gear orthogonally thereto, and a second gear operatively mounted within the housing for association with the first gear and the second gear rotatably mounted to a second gear axle that includes a second gear axis coaxially directed through the second gear with the second gear axle including a lower end rotatably mounted within the housing adjacent an upper end of the housing, and a file shaft axis eccentrically mounted relative to the second gear and offset relative to the second gear axis, and a file shaft means including a file shaft coaxially aligned relative to the housing, the file shaft mounted at one end to the file shaft axis interiorly of the housing for effecting reciprocation of the file shaft coaxially of the housing upon rotation of the second gear with a second free end of the file shaft extending exteriorly of the housing, and wherein the further portion of the housing includes a removable guard nose mounted overlying the file shaft means and the file shaft axis wherein the guard nose is removably mounted relative to the housing for access to the file shaft means to enable maintenance and replacement of the file shaft, and wherein the motor output drive shaft includes a flexible cable coaxially aligned through the housing extending exteriorly thereof and mounted to a motor positioned within a remote housing spaced from the elongate housing and including a flexible sheath housing the flexible drive cable therewithin, and wherein the motor output drive shaft is coaxially aligned and extends from an electric motor mounted adjacent the guard nose and includes at least one battery positioned rearwardly of the motor and coaxially aligned relative to the housing positioned rearwardly of the motor and a switch means for operative communication of the battery with the motor, and wherein the removable guard nose further includes a circular groove, the circular groove orthogonally aligned to and coaxially spaced above the second gear axis and accepting rotatably therewithin an upper terminal end of the file shaft axis within the circular groove for guiding the circular groove in rotation about the second gear axis, and wherein the removable guard nose further includes an elongate nose groove formed through a bottom surface of the removable guard nose for slidingly guiding the file shaft reciprocatably therethrough, and the elongate groove positioned orthogonally through the circular groove, and the elongate groove defined between spaced, parallel first guide walls, the first guide walls extending rearwardly within the guard nose and including second guide walls integrally joined to the first guide walls and defining an acute included angle therebetween.

2. An electric fingernail file apparatus as set forth in claim 1 wherein the file shaft means further includes a further file shaft axis directed through the file shaft adjacent a rear terminal end secured to an underlying connector plate, and a file gear arm including a gear arm axis directed through the gear arm into the underlying connector plate, and the gear arm including the file shaft axis mounted to the second gear, the file shaft axis, the second gear axis, the further file shaft axis, and the gear arm axis arranged parallel to each other.

* * * * *